US005097681A

United States Patent [19]

Steele

[11] Patent Number: 5,097,681

[45] Date of Patent: Mar. 24, 1992

[54] PIERCED EARRING WITH INTEGRAL LOCKING MECHANISM

[76] Inventor: Mickie L. Steele, 108 Wood Ave., Fayetteville, Ak. 72701

[21] Appl. No.: 627,575

[22] Filed: Dec. 14, 1990

[51] Int. Cl.[5] ..... A44C 7/00

[52] U.S. Cl. ..... 63/12; 24/610

[58] Field of Search ..... 63/12, 13; 24/609, 610

[56] References Cited

U.S. PATENT DOCUMENTS

| | | | |
|---|---|---|---|
| 276,993 | 5/1883 | Arnold | 63/12 |
| 721,692 | 3/1903 | Girdary | 63/12 |
| 4,468,936 | 9/1984 | Kirk | 63/12 |
| 4,543,804 | 10/1985 | Cappiello | 63/12 |

FOREIGN PATENT DOCUMENTS

| | | | |
|---|---|---|---|
| 31030 | 5/1885 | Fed. Rep. of Germany | 63/12 |
| 238184 | 9/1911 | Fed. Rep. of Germany | 63/12 |
| 2117625 | 10/1983 | United Kingdom | 63/12 |
| 2187930 | 9/1987 | United Kingdom | 63/12 |

*Primary Examiner*—Renee S. Luebke
*Assistant Examiner*—Flemming Saether
*Attorney, Agent, or Firm*—Boyd D. Cox

[57] ABSTRACT

An earring includes a stem or post to be inserted through a pierced ear and an elongated head portion rotatably attached to the end of the stem. The stem is provided with an elongate slot in which the rotatable head portion is retained. During an insertion of the stem through a wearer's ear, the head portion is axially aligned with and substantially retained within the slot. After insertion, the head portion is rotatable into a position transverse to the longitudinal axis of the stem so as to effectively retain the earring in the wearer's ear without the necessity of utilizing a separate conventional fastener.

7 Claims, 1 Drawing Sheet

PIERCED EARRING WITH INTEGRAL LOCKING MECHANISM

BACKGROUND OF THE INVENTION

1. Field of the Invention

The present invention relates to new and useful improvements in ear jewelry and more particularly pertains to a new and improved earring construction for pierced ears which includes the use of a rotatable head attached to the stem portion of an earring or the like, whereby the stem may be inserted through a wearer's ear and the rotatable head may then be moved into a position which prevents the stem, and thus the earring, from becoming disengaged from the wearer's ear, thereby to eliminate the need for a separate retaining fastener.

2. Description of the Prior Art

Piercing type earrings having stems or posts designed to pass through openings in earlobes are well known in the art. These earrings normally require the use of separable fasteners or clips that are attachable to end portions of the posts after the posts have been inserted through earlobe openings, thereby to prevent accidental withdrawal of the posts which could result in earring loss. With respect to piercing type earrings, it can be appreciated that substantial problems have been encountered in attempting to design fasteners which won't inadvertently become separated from the earring posts whereby a loss of the associated earring could result. This problem is particularly troublesome when an earring is made of a precious metal or is provided with precious stones inasmuch as a loss of the earring could result in considerable financial deprivation.

There have been several attempts to overcome the problem of losing earrings as a result of an inadvertent disengagement of associated fasteners. For example, U.S. Pat. No. 3,260,068, which issued to Arthur Micallef on July 12, 1966, and U.S. Pat. No. 3,446,033, which issued to Jesse Driscoll on May 27, 1969, both disclose earrings for pierced ears wherein the earrings include stems bent in a manner which effects a retaining of the associated earring in an earlobe without the necessity of utilizing a separate fastener on the stem. More particularly, both of these earring constructions rely upon the substantially transverse positioning of an angulated end portion of a stem with respect to an earlobe, thus to effect a frictional gripping action as occasioned by the attendant weight of the associated earring. While these designs may eliminate the need for a separable fastener, it can be appreciated that substantial difficulty and pain may be experienced in forcing these bent stems through an earlobe, while at the same time there still exists the possibility that the stems could become undesirably disengaged.

A different manner of attaching a single piece earring to an earlobe is disclosed in U.S. Pat. No. 3,446,034, which issued to Jesse Driscoll on May 27, 1969, wherein a complexly-designed attaching means is employed. In this patent, a hollow earring stem is designed to be inserted completely through an earlobe, while a flexible line extends partially through the hollow stem so as to extend out of one end thereof and also out of a separate opening centrally positioned on the stem. A pair of ornaments are attached to respective ends of the flexible line, with the post being positioned transverse to the earlobe after being inserted therethrough while both ends of the flexible line will extend through the earlobe opening. While tending to possibly retain an earring more securely than the above-discussed bent post constructions, it can be appreciated that this form of attaching means is complex to manufacture, requires that the ornaments be retained on flexible lines, and could also cause ear irritation due to the use of the pair of flexible lines through the earlobe opening as opposed to a smooth gold-plated earring post.

Accordingly, it is apparent that there exists a continuing need for improved pierced ear jewelry which eliminates the possibility of loss of separable fasteners while at the same time permitting a quick, secure and comfortable attachment of the associated earring to an earlobe. In this respect, the present invention substantially fulfills this need.

SUMMARY OF THE INVENTION

The general purpose of the present invention, which will be described subsequently in greater detail, is to provide new and improved pierced ear jewelry which has all of the advantages of the prior art pierced ear jewelry and none of the disadvantages. To attain this, the present invention envisions the use of an earring having a modified stem portion which includes an axially aligned slot. Rotatably secured within the stem slot is an elongate head portion whereby the head portion may be rotated into axial alignment with the slot, thus to present a stem which is easily inserted through an earlobe. After insertion through an earlobe, the head portion may be rotated into a transverse orthogonal relationship with the stem thus to effect a desired retention of the associated earring within the earlobe without the necessity of utilizing a separable fastener.

It is therefore an object of the present invention to provide new and improved pierced ear jewelry which has all of the advantages of the prior art pierced ear jewelry and none of the disadvantages.

It is another object of the present invention to provide new and improved pierced ear jewelry which may be easily and efficiently manufactured.

It is a further object of the present invention to provide new and improved pierced ear jewelry which may be securely and comfortably attached to earlobes.

Even another object of the present invention is to provide new and improved pierced ear jewelry having a reliable loss-preventing attaching means.

Still another object of the present invention is to provide new and improved pierced ear jewelry which eliminates the need for separable fasteners, thus to lessen the likelihood of loss of an associated earring.

An even further object of the present invention is to provide new and improved pierced ear jewelry which is susceptible of a low cost of manufacture with regard to both materials and labor, and which accordingly is then susceptible of low prices of sale to the consuming public, thereby making such earrings economically available to the buying public.

Still yet another object of the present invention to provide new and improved pierced ear jewelry which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DESCRIPTION OF THE PREFERRED EMBODIMENTS

Figure 1:
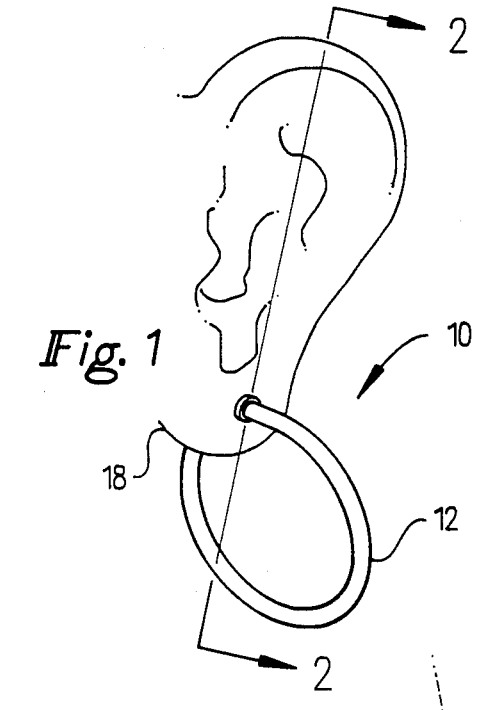
FIG. 1 is a perspective view of a piercing-type earring forming the present invention operably attached to a wearer's earlobe.
Figure 2:
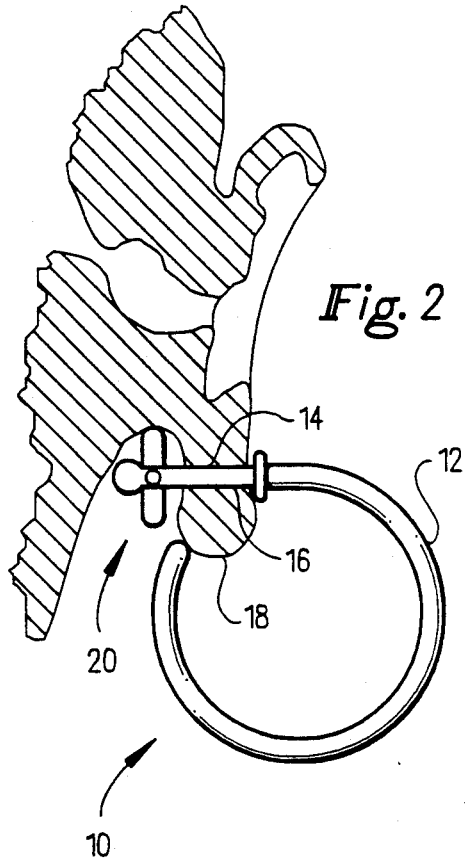
FIG. 2 is a cross-sectional plan view taken along the line 2—2 in FIG. 1.

With reference now to the drawings and in particular to FIGS. 1 and 2 thereof, a new and improved piercing type ear jewelry embodying the principles and concepts of the present invention and generally designated by the reference numeral 10 will be described. In this respect, it can be seen that the ear jewelry 10 may include an ornament portion 12 and an attachment stem or post 14 integrally or otherwise fixedly secured to the ornament portion. The stem 14 is designed to be inserted through a pierced opening 16 formed within a wearer's earlobe 18. With respect to the ornament portion 12, it is to be understood that the ring-like construction of the ornament portion illustrated in the drawings is only representative of virtually any conceivable configuration and design of ornament which may be employed in ear jewelry, to include the use of precious stones, metals, and the like. Accordingly, all such configurations and designs are within the purview of the described invention.

The attachment post 14 further includes a novel retaining means 20 which operates to prevent the disengagement of the post from the earlobe 18 after the post has been inserted through the opening 16.

Figure 3:
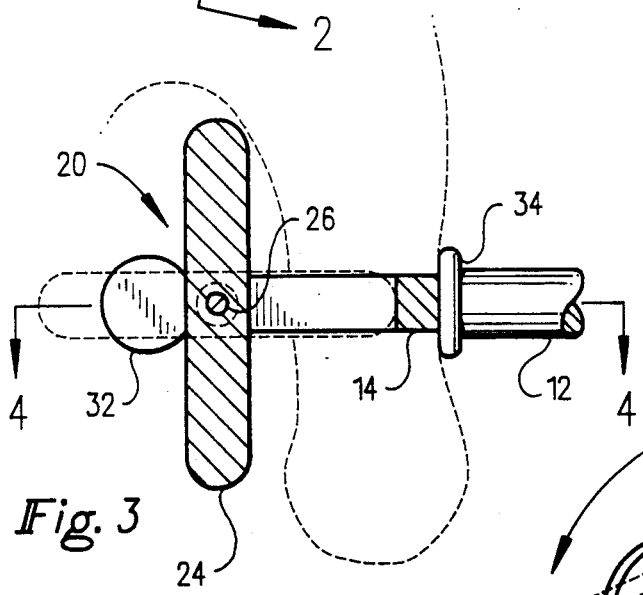
FIG. 3 is an enlarged detail view, partly in cross-section, which more particularly illustrates the manner of attachment of the present invention to an earlobe.
Figure 4:
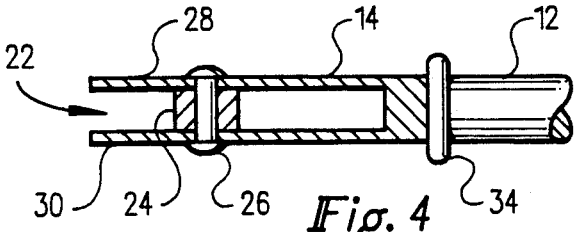
FIG. 4 is a top plan view, partly in cross-section, taken along the line 4—4 in FIG. 3.

As shown in FIGS. 3 and 4, the post 14 may include an elongate through-extending slot 22 extending over a partial axial length of the post and a rotatable head member 24 fixedly retained within the slot. As illustrated, the head member 24 is rotatable about a shaft 26 positioned within the slot 22 and extending between and through a pair of respective sidewalls 28, 30 forming a part of the post 14. The shaft 26 may be fixedly secured within the slot 22 between the sidewalls 28, 30 by any known conventional means, to include threadable attachment, welding, etc.

Also shown in FIG. 3 is the use of an optional bulbous end formed on an end portion of the post 14 and more particularly as a part of the respective sidewalls 28, 30. In this regard, the bulbous head portion 32 facilitates a spreading of the earlobe opening 16 during an insertion of the post 14 therethrough, thus to prevent any undesired discomfort which might otherwise be experienced as a result of the wearer's earlobe becoming undesirably pinched or otherwise engaged with the slot 22 during post insertion. Further, the spreading of the earlobe aperture 16 by the bulbous end member 32 also substantially eliminates any possibility of an undesired rotation of the head member 24 within the slot 22 prior to the complete insertion of the stem 14 through the earlobe 18, where such rotation of the head member might be otherwise occasioned by the frictional resistance of the earlobe if the earlobe opening was not sufficiently spread apart.

FIGS. 3 and 4 also illustrate the use of an expanded rim 34 on the ornament 12, such rim being integrally or otherwise fixedly secured thereto, with the purpose of the rim being to limit the depth of insertion of the post 14 within the earlobe opening 16. Inasmuch as a pierced earring post 14 desirably requires a plating with some precious metal, such as gold or the like, to thereby prevent infection and other possible ear irritation or discomfort, the use of the rim 34 limits the depth of penetration of the post 14 thus to effectively determine the amount of precious metal plating which needs to be applied to a post. Further, the rim 34 helps to facilitate a stable retention of the ear jewelry 10 in position in an earlobe 18, as well as to desirably retain the ear jewelry in a stable decorative position.

Figure 5:
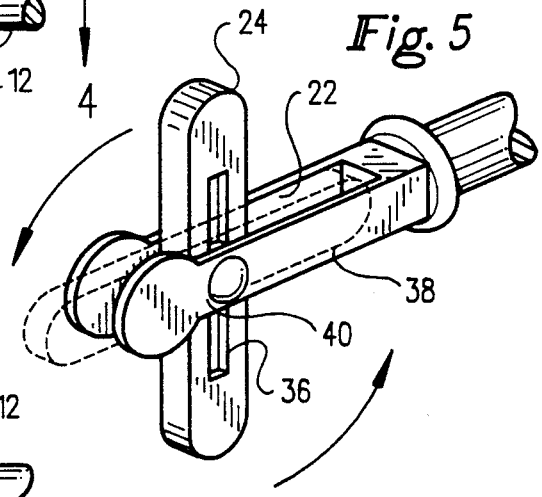
FIG. 5 is a perspective view of a modified embodiment of the present invention.

FIG. 5 illustrates an alternative embodiment of the present invention wherein the rotatable head member 24 is provided with an axially-extending, elongate slot 36. With respect to this further embodiment of the invention 10, the shaft 26 extending across the slot 22 also extends through the slot 36 in the head member 24. In this connection, the shaft 26 is slidably retained within the slot 36 whereby axial movement of the head member 24 with respect to the shaft 26 is afforded. This construction then permits the head member 24 to be axially aligned with the post 14 and to be substantially slid back into the slot 22 during an insertion of the post 14 through an earlobe opening 16. After a completed insertion of the post 14 through an earlobe opening 16, a wearer may then grasp the head member 24 and pull it in an axial direction outwardly from the slot 22 prior to rotating the head member into an orthogonal locking position as shown in FIG. 5. This construction then increases the ease and efficiency of attaching an earring 10 to an earlobe 18.

A further feature illustrated in the embodiment of the invention shown in FIG. 5 is the redesigning of the slot 22. More particularly, rather than cut the slot 22 completely through the post 14, one end of the slot may be cut only partially through the post whereby a blocking surface 38 is created within the slot. This construction then limits the extent of rotation of the head member 24 whereby once the head member is rotated in a clockwise manner into the slot 22, it will abut against the blocking surface 38 and be prevented from continued movement in a clockwise direction. A counterclockwise rotation of the head member 24 will then bring the same into the transverse locking position as shown in FIG. 5, while a lower portion 40 of the blocking surface 38 will effectively prevent continued counterclockwise rotation of the head member out of its locking position In use then, it can be appreciated that with respect to both embodiments of the invention, a wearer of a particular earring 10 need only to axially align the head member 24 with the post 14, so that the head member is substantially completely retained within the slot 22, and then insert the post through the earlobe opening 16. The bulbous end member 32 will effect a desired spreading of the earlobe opening 16 so that no binding or discomfort occurs during the insertion, and after the insertion of the post has been completed, the wearer may grasp the head member 24 and rotate it into orthogonal alignment with the post 14, thus to effect a desired retaining of the post and its associated ornament 12 in position within an earlobe 18. To remove an earring 10, just the opposite procedure is followed, i.e., the head member 24 is rotated back into axial alignment with the post 14 so as to be substantially again retained within the slot 22. whereby the post may be comfortably and quickly disengaged from the earlobe 18.

While a preferred embodiment of the invention has been described, it is to be understood that various other modifications are within the purview of this invention, to include such features as including a second bulbous member at the opposed end of the slot 22, thereby to effect a spreading of the earlobe opening 16 during a disengagement of the earring 10 from the earlobe 18. Further, various locking means could be employed to retain the head member 24 in both its orthogonal and axially aligned positions, to include roughened gripping surfaces, selectively positioned detent and ball arrangements, spring biasing means, etc. With respect to the above-description then, it should be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pierced earring for attachment to a wearer's earlobe, said earring comprising:

ornament means;

a post portion attached to said ornament means and being positionable through an opening in a wearer's earlobe;

a first slot formed at least partially through said post portion;

a shaft extending transversely across said first slot; and an elongated member possessing an axially extending second slot substantially centered between opposite ends of said elongated member, said shaft extending through said second slot such that said elongated member is mounted for reciprocal axial and rotatable movement with respect to said shaft, whereby said elongated member is movable to a locked position extending substantially transverse to said post portion with said shaft extending substantially centrally through said elongated member.

2. The pierced earring of claim 1, wherein said first slot extends only partially through said post portion forming a blocking surface for limiting the extent of rotation of said elongated member.

3. The pierced earring of claim 1, wherein said post portion is provided with an expanded bulbous end possessing a maximum width greater than a maximum width of said elongated member to facilitate insertion of said post portion through an earlobe opening.

4. The pierced earring of claim 1, wherein an expanded rim portion is provided between said ornament means and said post portion to limit extent of insertion of said post portion through an earlobe opening.

5. A pierced earring for attachment to a wearer's earlobe, said earring comprising:

ornament means;

a post portion attached to said ornament means and including an expanded bulbous end to facilitate insertion through an opening in a wearer's earlobe;

an expanded rim portion disposed between said ornament means and said post portion to limit extent of insertion of said post portion through an earlobe opening;

a first slot formed at least partially through said post portion;

a shaft extending transversely across said first slot, between said expanded rim and said bulbous end; and an elongated member possessing an axially extending second slot substantially centered between opposite ends of said elongated member, said shaft extending through said second slot such that said elongated member is mounted for rotatable movement with respect to said shaft, whereby said elongated member is movable to a locked position extending substantially transverse to said post portion.

6. The pierced earring of claim 5, wherein said first slot extends only partially through said post portion forming a blocking surface for limiting the extent of rotation of said elongated member.

7. A pierced earring for attachment to a wearer's earlobe, said earring comprising:

ornament means;

a post portion attached to said ornament means and including an expanded bulbous end to facilitate insertion through an opening in a wearer's earlobe;

an expanded rim portion disposed between said ornament means and said post portion to limit extent of insertion of said post portion through an earlobe opening;

a first slot formed in said post portion;

a shaft extending transversely across said first slot;

an elongated member possessing an axially extending second slot substantially centered between opposite ends of said elongated member, said shaft extending through said second slot such that said elongated member is mounted for reciprocal axial and rotatable movement with respect to said shaft; and said first slot extending only partially through said post portion and forming a blocking surface for limiting the extent of rotation of said elongated member whereby said elongated member is movable to a locked position extending substantially transverse to said post portion with said shaft extending substantially centrally through said elongated member and with an upper end surface of said elongated member in abutment with an upper inner surface of a wearer's earlobe thus preventing, in combination with said blocking surface and said expanded rim, unintended movement of said elongated member to an unlocked position.

* * * * *